United States Patent [19]

Sugars

[11] Patent Number: 4,555,154

[45] Date of Patent: Nov. 26, 1985

[54] ELECTRICAL CONNECTOR CONTACT RETENTION ASSEMBLY

[75] Inventor: John A. Sugars, Ogden, Utah

[73] Assignee: International Telephone & Telegraph Corp., New York, N.Y.

[21] Appl. No.: 563,855

[22] Filed: Dec. 21, 1983

[51] Int. Cl.[4] ..... H01R 11/00

[52] U.S. Cl. ..... 339/59 R; 339/59 M; 339/61 R

[58] Field of Search ..... 339/59, 60, 61, 217 S

[56] References Cited

U.S. PATENT DOCUMENTS

| | | | |
|---|---|---|---|
| 3,325,775 | 6/1967 | Zak | 339/256 |
| 3,441,661 | 4/1969 | Brummans | 174/138 |
| 3,601,760 | 8/1971 | Cairns | 339/59 M |
| 3,763,458 | 10/1973 | Taormina | 339/59 |
| 3,808,578 | 4/1974 | Hansen | 339/59 |
| 3,838,382 | 9/1974 | Sugar | 339/59 |
| 4,006,961 | 2/1977 | Langenbach | 339/217 |
| 4,387,944 | 6/1983 | Frear | 339/59 R |
| 4,394,058 | 7/1983 | Frear | 339/59 R |

*Primary Examiner*—Gil Weidenfeld
*Assistant Examiner*—Paula A. Austin
*Attorney, Agent, or Firm*—T. L. Peterson; R. C. Turner

[57] ABSTRACT

A contact retention assembly for a front insertion-front release socket contact in which the contact body behind the forward cylindrical mating end thereof is flattened and formed with a transverse opening. The bore in the cylindrical forward mating end of the contact communicates with the transverse opening. Resilient contact retention fingers extend inwardly and rearwardly from the wall of the contact passage to engage the rear wall of the transverse opening to restrict forward movement of the contact in the passage. A tool may be inserted through the forward end of the contact into the transverse opening to deflect the fingers outwardly to release the contact so that it may be removed from the front of the insulator.

8 Claims, 4 Drawing Figures

ELECTRICAL CONNECTOR CONTACT RETENTION ASSEMBLY

BACKGROUND OF THE INVENTION

The present invention relates generally to an electrical connector and, more particularly, to an electrical connector contact retention assembly for a front insertion-front release socket contact.

Both front and rear release contact retention assemblies have been utilized in the electrical connector art. A typical rear release arrangement using a metal clip having forwardly and inwardly extending retention fingers thereon is disclosed in U.S. Pat. No. 3,158,424. An annular clearance space is provided between the rear of the contact and the wall of the contact passage to allow a tool to be inserted into the space around the contact from the rear of the connector insulator in order to release the contact retention fingers, allowing the contact to the removed rearwardly from the insulator. A similar rear release contact retention assembly is disclosed in U.S. Pat. No. 3,165,369 which discloses contact retention fingers which are molded integrally with the insulator, rather than being formed on a separate metal contact retention clip. A front insertion, front release contact retention arrangement utilizing a retention clip similar to that disclosed in U.S. Pat. No. 3,158,424 is shown in French Pat. No. 2,240,600. In this case the clearance space which is required for insertion of a contact release tool is formed around the forward portion of the contact body, rather than the rear thereof as in the contact retention assemblies discussed previously herein. U.S. Pat. No. 3,838,382 discloses a rear release retention assembly for a tuning fork-type contact having a stamped body section with a rectangular opening formed therein. The passage in the insulator which receives the contact is formed with a pair of integral laterally resilient retention elements on opposite sides thereof. These elements are spread apart when the contact is inserted into the passage and contract into the opening in the contact when the later is aligned therewith to secure the contact in the passage. An extraction tool is inserted through the rear of the insulator around the outside of the rear termination portion of the contact to spread the retention elements apart, thus allowing the contact to be removed rearwardly from the passage.

In each of the arrangements discussed above, it is necessary that a clearance space be provided around either the forward or rear portion of the contact in the insulator to allow an extraction tool to be inserted into the contact passage to release contact retention fingers therein. Because such a clearance space is required around part of the contact body, the length of the contact within the contact passage must be relatively long in order to maintain the position of the contact radially. Otherwise, the contact may not have sufficient radial support to provide a stable mounting of the contact in the passage. Unstable contact mounting can result in failure of the contacts in the mating halves of the connector to properly slidably engage with each other.

Thus, what is desired and constitutes an object of the present invention is a contact retention assembly in which a clearance space for an extraction tool around the outside of the contact body is not required so that stability of the contact may be maintained with a relatively short contact length in the contact passage.

U.S. Pat. No. 3,325,775 discloses a contact retention arrangement for an electrical connector in which the contact extraction tool is inserted through the front of a hollow contact body rather than into a clearance space surrounding the contact. In this arrangement, the contact is formed of sheet metal and rolled into cylindrical form. The contact retention finger is stamped from one side of the cylindrical contact body and bent inwardly so that the end projects outwardly through an opening in the opposite side of the contact body. The end of the finger engages a forwardly facing shoulder in the contact passage to restrict rearward movement of the contact in the passage. When the tool is inserted through the forward end of the contact, the tip of the tool will engage the finger to deflect it inwardly, removing the end of the finger from the shoulder so that the contact may be removed rearwardly from the contact passage. A similar contact retention assembly is disclosed in U.S. Pat. No. 4,006,961 except that the contact extraction tool is inserted from the front of the insulator into a clearance space defined between the outer surface of the contact body and the wall of the contact passage. In each of these latter patents the contacts are inserted and removed from the rear of the connector insulator.

It is another object of the invention to provide a contact retention assembly wherein a contact may be inserted and removed from the connector insulator from the front, rather than the rear, yet without requiring a clearance space between the contact body and the wall of the contact passage for receiving an extraction tool, thus permitting stable mounting of the contact in the passage with a relatively short contact length therein.

SUMMARY OF THE INVENTION

According to a principal aspect of the present invention, there is provided a contact retention assembly for an electrical connector containing socket contacts. The section of the contact behind its forward hollow mating end has a transverse opening therein which is in communication with the bore which extends through the forward mating end of the contact. The rear of the opening provides a forwardly facing stop shoulder. A laterally movable contact retention element extends rearwardly and inwardly from the wall of the contact passage. The end of the retention element engages the stop shoulder to restrict forward movement of the contact in the passage. In order to release the retention element from the stop shoulder, a tool is inserted from the front of the insulator rearwardly through the bore in the forward mating end of the contact into the opening to deflect the contact retention element outwardly. With the end of the retention element disengaged from the stop shoulder in the contact body, the contact may be removed forwardly from the insulator. Because the tool is inserted through the interior of the contact, no clearance space is required around the outside of the contact body, thus allowing the forward mating end of the contact to have a close sliding fit within the contact passage to afford stable mounting of the contact in the passage without a relatively long contact as is required in most of the contact retention assemblies presently in use.

DESCRIPTION OF THE PREFERRED EMBODIMENT

Figure 1:
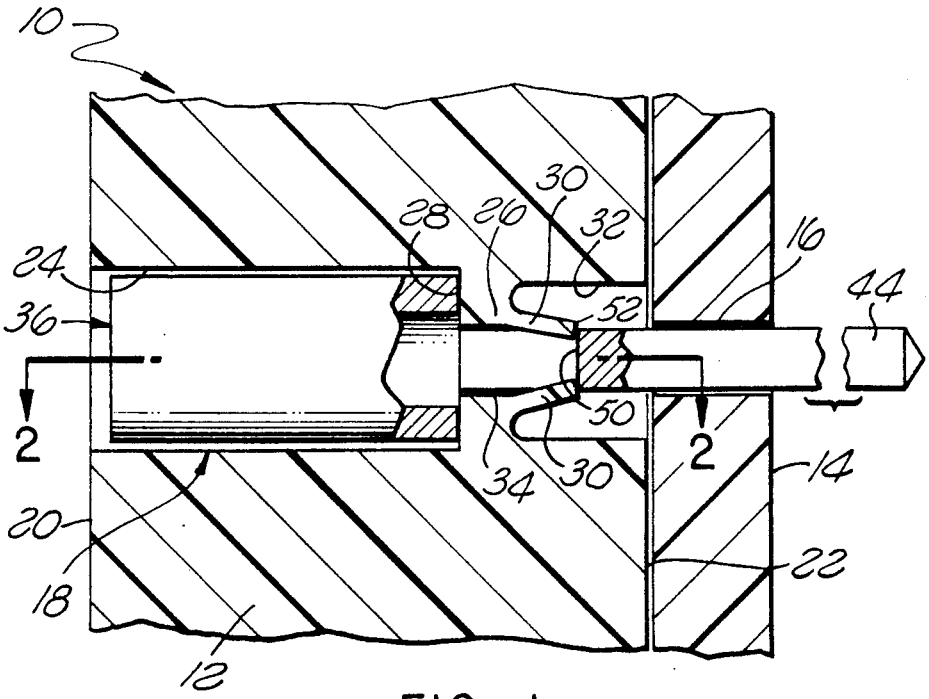
FIG. 1 is a fragmentary sectional view through a connector insulator embodying the contact retention assembly of the present invention, the insulator being shown mounted on a flat panel.

Referring now to the drawing in detail, there is illustrated an electrical connector, generally designated 10, which comprises an insulator 12 that is mounted on a panel 14. The panel contains a plurality of holes 16, only one being shown. The insulator 12 contains a plurality of contact passages 18 (only one being shown) which extend from the front face 20 of the insulator to the rear face 22 thereof, and are aligned with the holes 16.

Each contact passage 18 includes a relatively large diameter cylindrical forward section 24 which extends from the front face 20 of the insulator rearwardly to an inwardly extending flange 26. The flange provides a forwardly facing annular shoulder 28. A pair of inwardly and rearwardly extending resilient contact retention fingers 30 are formed integral with the rear portion of the flange 26. The fingers extend into the rear section 32 of the contact passage which is in communication with the forward section 24 via a reduced diameter intermediate section 34 formed by the interior surface of the flange 26.

The novel socket contact of the invention, generally designated 36, is mounted in the contact passage 18 from the front of the insulator 12. The contact embodies a forward cylindrical mating section 38 which is adapted to slidably receive therein a pin contact of a mating connector member, not shown. The forward section may be longitudinally split to provide resilience to make good electrical contact with the mating pin contact, or the forward section could be formed with inwardly extending spring fingers stamped from the wall of the contact. The rear section 40 of the contact is preferably flat, and extends rearwardly from the rear annular surface 42 of the forward cylindrical mating section 38 of the contact. The rear section includes a relatively narrow tail of rectangular cross-section, which extends rearwardly from the rear face 22 of the insulator through the hole 16 in the panel 14. If the panel 14 were a printed circuit board, as shown, the hole 16 may be a plated-through hole, in which case the corners of the tail 44 would tightly engage the plating of the hole to provide electrical contact therebetween. Alternatively, the tail 44 could be soldered to the plating within the hole 16. In a further alternative arrangement, panel 14 could be a metal backpanel in which case an insulated bushing, not shown, would surround the tail 44 in the hole 16 to electrically isolate the tail from the backpanel. In such an arrangement the tail 44 of the contact would be utilized for wrapping with wires as is well known in the electronics packaging art.

Figure 2:
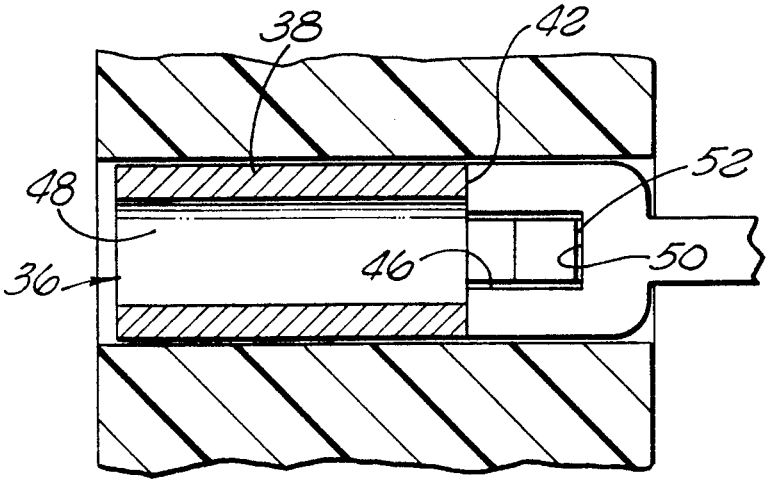
FIG. 2 is a fragmentary sectional view taken along line 2—2 of FIG. 1, with the mounting panel removed.
Figure 3:
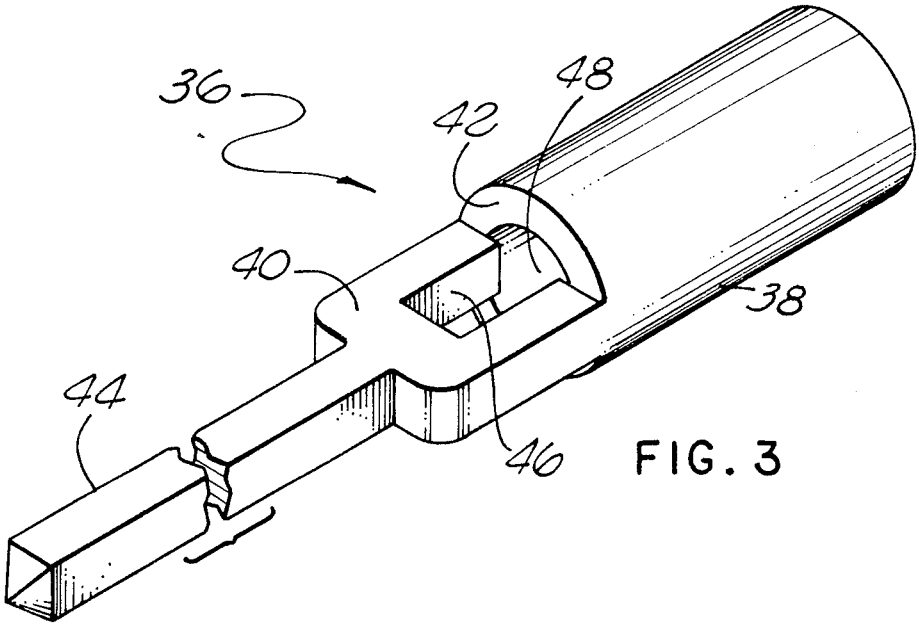
FIG. 3 is a perspective view of the contact illustrated in FIGS. 1 and 2.

An opening 46 extends transversely through the flattened rear section 40 of the contact body. The opening extends forwardly to the forward cylindrical mating section 38 of the contact so that the opening will be in communication with the bore 48 extending through the forward section. The rear wall 50 of the opening 46 provides a forwardly facing stop shoulder which is engaged by the free ends 52 of the retention fingers 30 when the contact 36 is mounted within the passage 18 as seen in FIGS. 1 and 2.

The contact 36 is mounted in the passage 18 from the front of the insulator by initially aligning the tip of the tail 44 with the center axis of the passage so that the tip will slide into the intermediate bore section 34 of the passage. As the tail is slid through the bore 34, the resilient fingers 30 will be deflected outwardly until the opening 46 in the contact body reaches the position illustrated in FIGS. 1 and 2, whereupon the fingers 38 will snap inwardly into the opening so that the ends 52 of the fingers will engage the shoulder 50 thereby restricing forward movement of the contact in the passage 18. In this position of the contact in the passage, the rear 42 of the forward mating end 38 of the contact engages the annular stop shoulder 28 in the contact passage so that rearward movement of the contact will be prevented.

Figure 4:
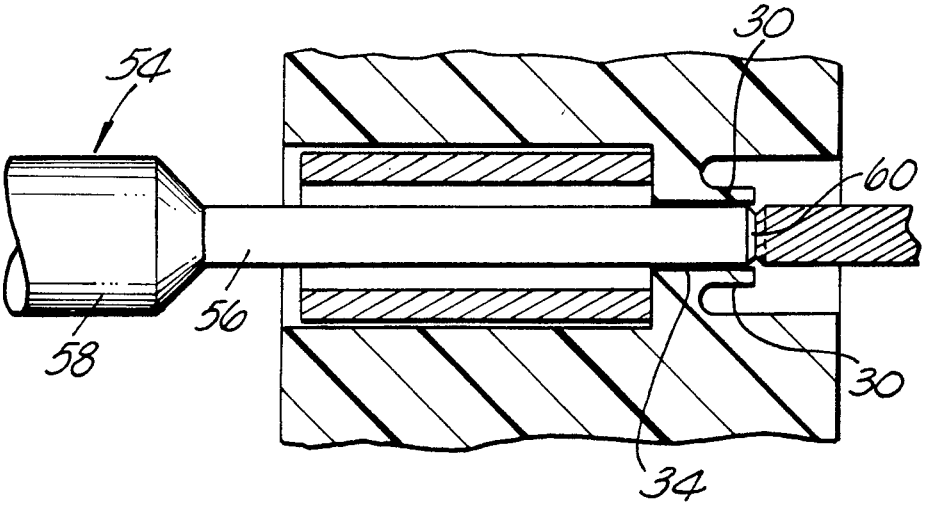
FIG. 4 is a fragmentary sectional view similar to FIG. 1 showing an extraction tool inserted into the contact in position to release the contact retention fingers of the contact retention assembly.

In order to remove the contact from the passage 18, an extraction tool as illustrated in FIG. 4 may be utilized, generally designated 54. The tool comprises an elongated cylindrical rod 56 having a handle 58 on the rear of the rod. Preferably, the forward end of the rod is beveled as indicated at 60. To withdraw the contact from the passage 18, the retention fingers 30 must be spread apart to disengage the ends 52 of the fingers from the shoulder 50 on the contact. To accomplish this, the rod 56 of the tool is inserted through the bore 48 in the forward mating end 38 of the contact into the opening 46 in the flat rear section of the contact until the forward end of the rod deflects the retention fingers outwardly in the manner just described, and as illustrated in FIG. 4. With the fingers spread apart, both the contact and tool may be removed from the front of the insulator 12.

By the contact retention assemby of the present invention there is no necessity of there being provided a clearance space between the outer surface of the forward mating section 38 of the contact and the wall of the contact passage 18 for receiving an extraction tool. In contrast, the tool is inserted through the center of the socket contact of the present invention. As a consequence, the forward mating section 38 of the contact may have a close sliding fit within the forward section 24 of the contact passage so that a close radial support, and thus a stable mounting of the contact, may be achieved within the insulator even though the contact may have a relatively short length within the insulator. This allows the insulator to be relatively narrow, thus reducing the height or profile of the connector. Furthermore, by the present invention the contact may be inserted and removed from the front of the connector insulator, which is not possible in the aforementioned U.S. Pat. No. 3,325,775 in which the contact is released by inserting a tool through the interior of the forward mating end of the contact.

What is claimed is:

1. An electrical connector member comprising:

an insulator having at least one passage extending therethrough from a front face to a rear face thereof;

an electrical socket contact in said passage insertable therein from the front of said insulator;

said socket contact having a forward hollow section and a rear section;

said forward hollow section of said contact having a close sliding fit within said passage;

said forward section having a bore therethrough communicating with an opening in said rear section;

the rear of said opening providing a forwardly facing shoulder;

a laterally movable contact retention element extending rearwardly and inwardly from the wall of said passage, the end of said retention element engaging said shoulder for restricting forward movement of said contact in said passage; and said retention element being deflected outwardly to remove said end thereof out of engagement with said shoulder by inserting a tool from the front of said insulator rearwardly through said bore into said opening.

2. An electrical connector member as set forth in claim 1 wherein:

said insulator embodies a forwardly facing shoulder in said passage in front of said contact retention element; and said contact has a rearwardly facing surface thereon between said forward and rearward sections thereof engaging said shoulder in said passage to restrict rearward movement of said contact in said passage.

3. An electrical connector member as set forth in claim 1 wherein:

said opening extends transversely through said rear section.

4. An electrical connector member as set forth in claim 2 wherein:

there are provided a pair of said contact retention elements located on opposite sides of said rear section, with the ends of both said retention elements engaging said shoulder.

5. An electrical connector member as set forth in claim 1 wherein:

said rear section of said contact is relatively flat;

said opening extends transversely through said rear section; and there are provided a pair of said contact retention elements positioned on opposite sides of said rear section, with the ends of both of said retention elements engaging said shoulder.

6. An electrical connector member as set forth in claim 6 wherein:

said contact retention elements are resilient fingers integral with the wall of said passage.

7. An electrical connector member comprising:

an insulator having at least one passage extending therethrough from a front face to a rear face;

an electrical socket contact in said passage insertable therein from the front of said insulator;

said socket contact having a forward hollow section and a generally flat rear section;

said forward section having a close sliding fit within said passage;

said forward section having a bore therethrough communicating with an opening in said rear section, said opening extending transversely through said rear section with the rear of said opening providing a forwardly facing shoulder;

a pair of resilient contact retention fingers located on opposite sides of said rear section;

each of said fingers extending rearwardly and inwardly from the wall of said passage, the end of each said finger engaging said shoulder for restricting forward movement of said contact in said passage; and said fingers being deflected outwardly to remove said ends thereof out of engagement with said shoulder by inserting a tool from the front of said insulator rearwardly through said bore into said opening.

8. An electrical connector member as set forth in claim 7 wherein:

said insulator embodies a forwardly facing shoulder in said passage in front of said fingers; and said contact has a rearwardly facing surface thereon between said forward and rear sections thereof engaging said shoulder in said passage to restrict rearward movement of said contact in said passage.

* * * * *